United States Patent [19]

Hubbard

[11] Patent Number: 5,060,606

[45] Date of Patent: Oct. 29, 1991

[54] ROCKER ARM

[75] Inventor: Donald G. Hubbard, Jackson, Mich.

[73] Assignee: Camshaft Machine Company, Jackson, Mich.

[21] Appl. No.: 567,102

[22] Filed: Aug. 14, 1990

[51] Int. Cl.[5] ..... F01L 1/18

[52] U.S. Cl. ..... 123/90.39; 123/90.41; 74/519; 74/559

[58] Field of Search ..... 123/90.39, 90.4, 90.41, 123/90.42, 90.44, 90.45, 90.47; 74/519, 559

[56] References Cited

U.S. PATENT DOCUMENTS

| | | | |
|---|---|---|---|
| 2,176,083 | 10/1939 | Leake | 74/519 |
| 2,219,361 | 10/1940 | Haberstump | 123/90.39 |
| 2,338,726 | 1/1944 | Leake | 74/519 |
| 2,905,161 | 9/1959 | Latham | 123/90 |
| 3,142,357 | 7/1964 | Thompson | 184/6 |
| 3,251,350 | 5/1966 | Thompson | 123/90 |
| 3,289,657 | 12/1966 | Winter, Jr. | 123/90.41 |
| 3,314,404 | 4/1967 | Thompson | 74/519 |
| 4,182,290 | 1/1980 | Pohle | 123/90.39 |
| 4,440,121 | 4/1984 | Clancy et al. | 123/90.39 |
| 4,497,307 | 2/1985 | Paar et al. | 123/90.33 |
| 4,674,453 | 6/1987 | Dove, Jr. | 123/90.39 |
| 4,697,473 | 10/1987 | Patel | 74/519 |
| 4,718,379 | 1/1988 | Clark | 123/90.41 |
| 4,727,832 | 3/1988 | Miyamura et al. | 123/90.39 |
| 4,961,407 | 10/1990 | McWhirter | 123/90.41 |

FOREIGN PATENT DOCUMENTS

| | | | |
|---|---|---|---|
| 0064836 | 11/1982 | European Pat. Off. | 123/90.39 |
| 2082718 | 3/1982 | United Kingdom | 123/90.39 |

*Primary Examiner*—David A. Okonsky
*Assistant Examiner*—Weilun Lo
*Attorney, Agent, or Firm*—Beaman & Beaman

[57] ABSTRACT

A cast rocker arm for operating the valve train of internal combustion engines characterized by its light weight and use of anti-friction bearings to reduce frictional forces and increase engine mileage. The cast construction produces a light weight, and includes a box or channel cross-sectional configuration to achieve high strength with a minimum of material.

20 Claims, 2 Drawing Sheets

ROCKER ARM

BACKGROUND OF THE INVENTION

Due to government regulations mandating increasingly higher mileage standards for vehicles manufacturers of internal combustion engines explore every avenue to increase the efficiency of the engine to improve the vehicle mileage characteristics.

Internal combustion engine efficiency is determined by a number of engine factors, such as compression ratios, speed of operation, number of valves in each cylinder, spark plug placement, combustion chamber configuration, etc., and one of the very significant factors affecting engine efficiency is the extent of the friction resulting from relatively movable components. Friction is also usually directed to weight characteristics and engine efficiency is increased as friction and weight factors are reduced.

The engine valve train components for operating the cylinder valves are relatively complex, numerous, and a source of considerable energy loss due to friction. The energy required to operate the valve train has sought to be reduced by lowering the weight of the valve train rocker arm, and relatively thin wall rocker arm constructions have been proposed wherein the rocker arm is formed of sheet metal as typically shown in U.S. Pat. Nos. 2,176,083; 2,338,726 and 3,142,357. Friction forces can also be reduced by using roller members mounted on the rocker arm for engaging the valve train as shown in U.S. Pat. Nos. 2,176,083 and 4,182,290.

As valve train rocker arms are exposed to significant pivoting forces by the camshaft or push rod actuator displaced by the camshaft it is known to use anti-friction bearings, such as ball or roller bearings, to support the rocker arm or rocker arm mounted mechanism associated with the cam, and typical proposals are shown in U.S. Pat. Nos. 4,497,307; 4,697,473 and 4,718,379 wherein frictional forces are reduced by the use of anti-friction bearings.

Sheet metal rocker arm constructions do not readily accept antifriction bearings, are not rigid, and present rocker arm fabrication and manufacture has not eliminated all of the energy wasting and frictional loss from the valve train system. Improvements in the operating characteristics of a valve train can result in one or two miles per gallon in vehicle ratings.

It is an object of the invention to provide a valve train rocker arm of a rigid lightweight cast metal construction utilizing primary anti-friction support bearings and having a configuration providing a high strength and stiffness in combination with low weight.

Another object of the invention is to provide a rocker arm for internal combustion engines wherein the rocker arm is formed of a cast metal having substantially parallel or tapered side flanges and wherein the flanges are interconnected by homogeneous webs, the webs and side flanges together forming a high strength box or channel configuration permitting the forming of a lightweight rocker arm with a minimum of material.

In the practice of the invention the valve train rocker arm is formed by a casting method, such as investment casting or by sand casting. The rocker arm body consists of a pair of substantially parallel lateral side flanges each having a central region and ends. The flanges are the mirror image of each other, of an elongated configuration, and the portion of the body between the central region and one end constitutes a valve engaging arm while the opposite region constitutes an actuator engaging arm.

Centrally, the side flanges are formed with coaxial openings for receiving anti-friction ball bearings which are mounted upon the rocker arm support structure, and the bifurcated terminal end of the valve engaging arms preferably receives a valve train engaging anti-friction roller or bearing, while the opposite end of the rocker arm body includes a thrust bearing recess engaging the end of an actuator push rod operated by the engine camshaft.

The side flanges are relatively thin in dimension in a direction transverse to the plane of rocker arm operative movement, while the side flange dimension in the direction of plane movement is sufficiently high to resist bending and deflection during rocker arm operation. Homogeneous webs interconnect the side flanges, and a pair of spaced webs located intermediate the flanges central region and the end of the valve engaging arms whereby the resulting box cross-section configuration or the channel cross-section configuration used with investment casting or a poured casting provides a high strength interconnection between the side flanges with the addition of little weight.

Primary anti-friction bearings located in the side flanges at the central region thereof provide low friction support of the rocker arm during movement, and in the preferred construction an anti-friction roller located at the bifurcated end of the flanges the valve train.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
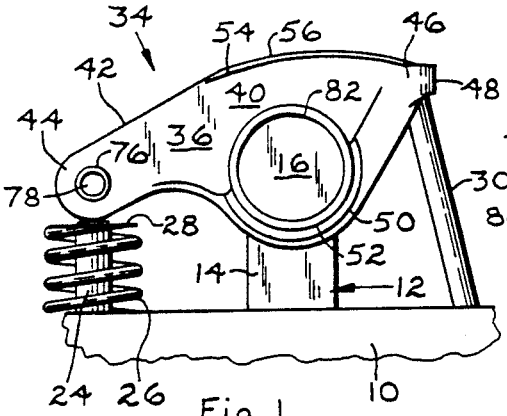
FIG. 1 is an elevational view of a rocker arm assembly in accord with the invention illustrating a portion of the valve train and actuator push rod.

The invention pertains to a rocker arm of the type conventionally utilized in the valve train of an internal combustion engine. In FIG. 1 the typical environment of use of a valve train rocker arm is disclosed wherein the engine cylinder head is represented at 10 and provides the base for the rocker arm assembly support 12.

Figure 2:
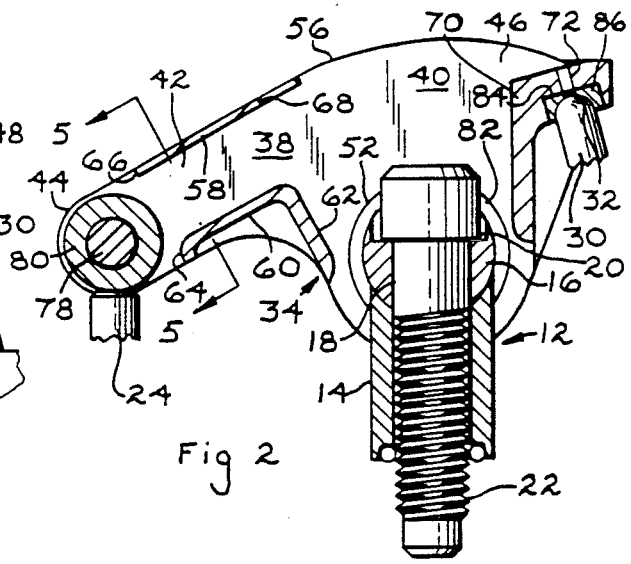
FIG. 2 is an elevational sectional view as taken along Section 2—2 of FIG. 3.

The rocker arm support 12 consists of a rectangular column 14, FIG. 2, supporting a horizontally disposed cylindrical journal 16. The journal 16 includes a diametrical bore 18 which is concentrically countersunk at 20 for receiving the head of the bolt 22 which extends through the journal bore 18 and the column 14. The cylinder head 10 is provided with a threaded hole for receiving the bolt 22 and tightening of the bolt firmly attaches the support 12 to the cylinder head 10.

The rocker arm valve train includes a valve stem 24 which is biased outwardly by a spring 26 engaging the spring plate 28 attached to the valve stem adjacent its end. It is to be understood that the representation of the valve stem 24 in FIG. 1 is of a generally schematic nature and the valve train of internal combustion engines take a variety of configurations as well known in the art.

The rocker arm is operated by the actuator or push rod 30 extending from the engine block 10, and at its lower end, not shown, the push rod usually rides upon a camshaft follower and lobe, or related mechanism, wherein rotation of the camshaft will reciprocate the push rod in the known manner. The push rod includes a convex radius end 32 as will be appreciated from FIG. 2.

The rocker arm body is generally indicated at 34, and preferably, the body 34 is formed as a metal casting. For instance, formation of the body 34 by an investment casting procedure produces the desired configuration resulting in low weight and high strength and stiffness. The weight and stiffness characteristics of the body 34 are, to a large extent, the result of the configuration of the rocker body as described below.

The rocker arm body 34 primarily consists of a pair of spaced parallel sides flanges 36 and 38. The side flanges are of an elongated configuration and are mirror images of each other. Each of the side flanges includes a central region 40, a valve engaging arm 42 having an end at 44 and an actuator engaging arm 46 having an end at 48.

At their central regions 40 the side flanges 36 and 38 are provided with generally circular hub extensions 50 which extend outwardly from the associated side flanges and the hub extensions are provided with cylindrical bores 52. The bores 52 formed at each of the side flanges are aligned and coaxial. The hub extensions are thick on the lower portion and thin at the upper portion to reduce weight.

Each of the side flanges includes reinforcing ribs 54, and an upper edge 56 as viewed in FIGS. 1 and 2. With respect to the vertical orientation shown in FIGS. 1, 2 and 5 the side flanges 36 and 38 are interconnected by an upper web 58 and a lower web 60. The webs 58 and 60 are homogeneously formed of the material of the rocker arm body 34 and the lower web 60 includes web shoulders 62 and 64 disposed at substantially right angles to the plane of the web 60.

Figure 3:
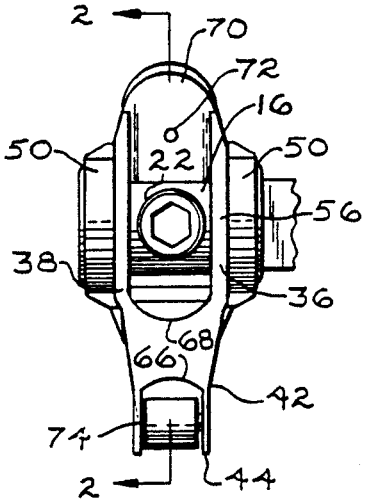
FIG. 3 is a top plan view of a rocker arm assembly in accord with the invention.
Figure 4:
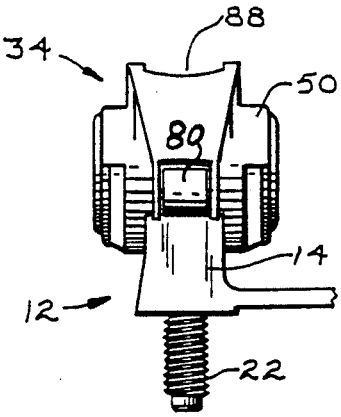
FIG. 4 is a front view of the rocker arm assembly.

The upper web 58 includes an outer web end 66 and an inner web end 68 as will be appreciated from FIG. 3. As will be noted from FIGS. 2 and 5, the upper web 58 engages the side flanges 36 and 38 at their respective linear edge 56.

Figure 5:
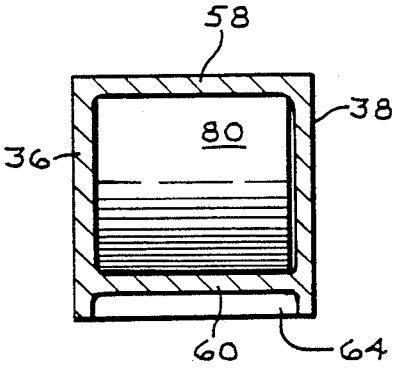
FIG. 5 is an elevational sectional view as taken along Section 5—5 of FIG. 2.

Of significance to the inventive concept is the fact that the webs 58 and 60 in conjunction with the side flanges 36 and 38 define a rectangular box configuration as is readily apparent in the section of FIG. 5. This box configuration imparts to the body 34 a high strength with the use of little material, and as the valve engaging arm 42 of the side flanges is longer than the actuator engaging arm 46 greater forces are imposed upon the arms 42 and the presence of the box truss configuration as shown in FIG. 5 provides adequate strength to the arms 42 to resist deformation or fracture under the most rigorous operating conditions.

The actuator arm ends 48 are interconnected by the push rod web 70, and the web 70 includes a lubrication passage 72 for communicating with the push rod pad as later described.

The valve engaging arm ends 44 form a bifurcation 74, FIG. 3, and the arms 42 are drilled at 76 to define a bore for receiving the roller pin 78. A hardened roller 80 is rotatably mounted upon the solid or tubular pin 78 between the valve engaging arm ends 44 and the roller 80 engages the end of the valve stem 24 as will be readily appreciated from FIGS. 1 and 2.

An anti-friction bearing 82, such as ball bearings, are received within the side flange extension bores 52 and the inner diameter of the bearings 82 substantially corresponds to the diameter of the support journal 16 whereby the rocker arm body 34 is rotatably mounted upon the journal 16 by the anti-friction bearings 82. In this manner the rocker arm body 34 is movably mounted upon the support 12 in a low friction manner.

The push rod web 70 includes a cylindrical recess 84 for receiving the push rod cushion 86 formed of metal, and the cushion 86 includes an oil passage communicating with the passage 72 whereby oil coming up the push rod will lubricate the fulcrum shaft bearings and roller or pad.

Due to the spacing of the side flanges 36 and 38 access to the head of the bolt 22 is readily provided as will be appreciated from FIG. 3.

The configuration of the rocker arm body 34 as defined by the flanges 36 and 38, and other components produces a stiff high strength rocker arm with a minimum of material which significantly reduces the rocker arm body weight and allows higher engine speeds without valve float. This reduction in weight, in conjunction with the use of the anti-friction ball bearings 82, and the low friction roller 80, provides a significant reduction in the frictional forces required to operate the rocker arm and associated valve train resulting in higher engine efficiency, power and greater vehicle mileage.

Figure 6:
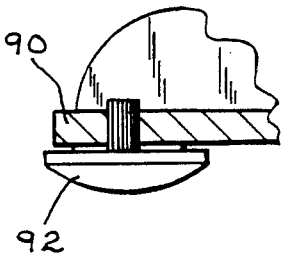
FIG. 6 is a detail elevational view of an embodiment of the invention employing a non-rotative valve train engaging pad formed upon the valve engaging arm end of the rocker arm.
Figure 7:
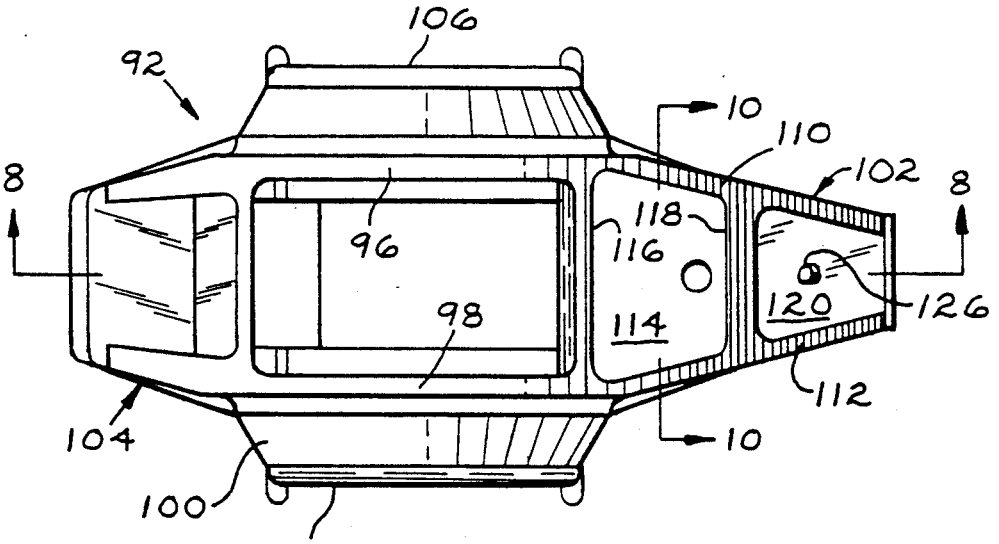
FIG. 7 is an enlarged top view of another embodiment of a rocker arm body utilizing a channel cross-sectional reinforcement configuration.
Figure 8:
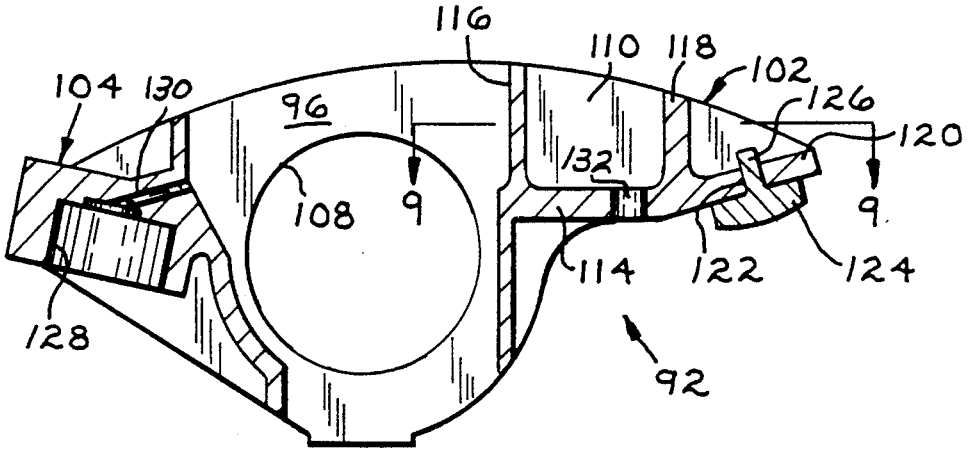
FIG. 8 is an elevational sectional view as taken along Section 8—8 of FIG. 7.
Figure 9:
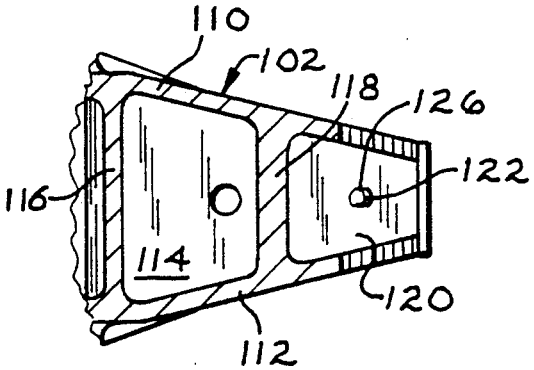
FIG. 9 is a plan sectional view as taken along Section 9—9 of FIG. 8.

FIG. 6 illustrates a variation to the previously described embodiment in that by employing a web 90 between the valve engaging arm ends 44 such that the arm ends are no longer bifurcated. A convex pad 92 may be located upon the web 90 for engagement with the upper end of the valve stem 24. This arrangement is less expensive than the use of the roller 80.

A variation of a rocker arm utilizing the concepts of the invention is shown in FIGS. 7–10 of the drawing. In this variation the construction is such as to permit the rocker arm body to be formed by casting using simpler molding processes, such as sand molding or the like, and this embodiment does also use a box cross-section in the valve engaging arm formed by side flanges 110 and 112 and webs 116 and 118.

With reference to FIGS. 7–10, the body 92 is of a configuration generally similar to that of the body 34 described above. The body 94 is formed with side flanges 96 and 98 which are parallel to each other in the region of the body hub, i.e. the central region 100, and the side flanges are of a converging configuration as they form the valve engaging arm 102 and the actuator engaging arm 104. The hub extensions 106 extend transversely from the plane of the side flanges at the central region 100 and at the central region the body flanges and hub extensions are provided with the bore 108 for receiving the antifriction bearings as described above.

Figure 10:
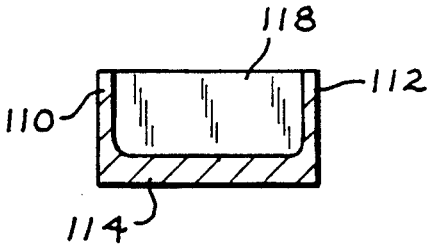
FIG. 10 is an elevational sectional view taken through the channel cross-sectional configuration along Section 10—10 of FIG. 7.

The valve engaging arm 102 is defined by the converging flange portions 110 and 112 and these flange portions together with the bottom 114 define a channel or U-shaped configuration as will be appreciated from FIG. 10. This reinforcing configuration of the valve engaging arm is further augmented by webs 116 and 118 homogeneously interposed between the portions 110 and 112 and lying in planes parallel to each other.

The flange portions 110 and 112 also are homogeneously associated with the web 120 which is provided with hole 122 for receiving and supporting the valve train engaging pad 124.

The pad 124 includes a stem 126 received within the hole 122.

The actuator engaging arm 104 is provided with a recess 128 for receiving a push rod pad such as illustrated at 86 with respect to FIG. 2. Oil holes 130 and 132 are provided in the rocker arm to provide lubrication to the push rod and pad 124.

The rocker arm body shown in FIGS. 7–10 is used in a manner identical to that of the embodiment of FIGS. 1 6, but the configuration of the box and channel shaped valve engaging arm permits a rocker arm body to be constructed in accord with the inventive concepts by casting procedures other than investment casting.

It will be appreciated that the objects of the invention are achieved by the disclosed structure, and it will be understood that various modifications to the inventive concepts may be apparent to those skilled in the art without departing from the spirit and scope of the invention.

I claim:

1. A rocker arm for use in the valve train of an internal combustion engine comprising, in combination, a unitary, homogeneous metal body having a pivot axis, a valve engaging arm extending in a first direction, and an actuator engaging arm extending in a second direction substantially opposite to said first direction, said valve and actuator engaging arms being located on opposite sides of said pivot axis, said arms each having an outer cantilever end and an inner region adjacent said pivot axis, said valve engaging arm inner region having a closed box cross sectional configuration including a bottom, actuator engaging means defined on said actuator engaging arm outer end and valve engaging means defined on said valve engaging arm outer end.

2. In a rocker arm as in claim 1, said body being formed of cast metal.

3. In a rocker arm as in claim 2, said body being formed of cast steel.

4. In a rocker arm as in claim 1, said body including a pair of spaced lateral side flanges defining said valve and actuator engaging arms, said closed box across sectional configuration comprising a rectangular box transverse cross section including said side flanges, an upper web interconnecting said side flanges at first locations and a lower web interconnecting said flanges at second locations.

5. In a rocker arm as in claim 4, said upper and lower webs being substantially parallel.

6. In a rocker arm as in claim 4, said lateral side flanges each including a first edge, said upper web being interconnected to said side flanges at said first edges.

7. In a rocker arm as in claim 4, a cylindrical bore defined in each of said side flanges concentric to said pivot axis, and an anti-friction bearing within each of said bores defining said pivot axis.

8. In a rocker arm as in claim 7, said side flanges defining said valve engaging arm outer cantilever end being of a bifurcated configuration, and an anti-friction bearing mounted within said bifurcated configuration having an axis of rotation substantially parallel to said body pivot axis.

9. A rocker arm for use in the valve train of an internal combustion engine comprising, in combination, a unitary, homogeneous metal body having a pivot axis, a valve engaging arm extending in a first direction, and an actuator engaging arm extending in a second direction substantially opposite to said first direction, said valve and actuator engaging arms being located on opposite sides of said pivot axis, said arms each having an outer cantilever end and an inner region adjacent said pivot axis, said valve engaging arm inner region having a closed box cross sectional configuration including a bottom, actuator engaging means defined on said actuator engaging arm outer end and valve engaging means defined on said valve engaging arm outer end, said body including a pair of spaced lateral sides flanges defining said valve and actuator engaging arms, said closed box cross sectional configuration comprising a rectangular box transverse cross section including said side flanges, an upper web interconnecting said side flanges at first locations and a lower web interconnecting said flanges at second locations, said upper and lower webs being substantially parallel, said lateral side flange each including a first edge, said upper web being interconnected to said side flange at said first edges, said body, side flanges and webs being formed by investment casting.

10. A rocker arm for use in the valve train of an internal combustion engine comprising, in combination, a unitary, homogeneous metal body having a pivot axis, a valve engaging arm extending in a first direction, and an actuator engaging arm extending in a second direction substantially opposite to said first direction, said valve and actuator engaging arms being located on opposite sides of said pivot axis, said arms each having an outer cantilever end and an inner region adjacent said pivot axis, said valve engaging arm inner region having a closed box cross sectional configuration including a bottom, actuator engaging means defined on said actuator engaging arm outer end and valve engaging means defined on said valve engaging arm outer end, said body including a pair of spaced lateral sides flanges defining said valve and actuator engaging arms, said closed box cross sectional configuration comprising a channel shaped cross section having side flanges extending therefrom, an outer web interconnecting said side flange at first locations and an inner web interconnecting said flanges at second locations forming a trapezoidal box cross-section.

11. A rocker arm for use in the valve train of an internal combustion engine comprising, in combination, a cast metal body including a pair of spaced lateral elongated side flanges, said side flanges being substantially the mirror image of each other and each having a central region and each defining a valve engaging arm and an actuator engaging arm on opposite sides of the associated central region, web means interconnecting said side flanges maintaining said flanges in a substantially parallel spaced aligned relationship, pivot means defined in each central region of said flanges, said pivot means of said flanges being aligned and coaxial and defining a pivot axis substantially perpendicular to the length of said flanges, said arms each having an end, valve engaging means defined at said end of said valve engaging arm and actuator engaging means defined at said end of said actuator engaging arm, said web means including a pair of spaced webs defining a transverse cross sectional configuration including a bottom having wall portions extending from said bottom intermediate said pivot means and said end of said valve engaging arm.

12. In a rocker arm as in claim 11, said web means defining a rectangular box transverse cross sectional configuration

13. In a rocker arm as in claim 11, said bottom and wall portions defining a channel shaped configuration.

14. In a rocker arm as in claim 12, said body being formed by investment casting.

15. In a rocker arm as in claim 12, said lateral side flanges each including a first edge, said web means including a web homogeneously connected to said first edge of said flanges.

16. In a rocker arm as in claim 11, a cylindrical bore defined in each of said side flanges concentric to said pivot axis, and an anti-friction bearing within each of said bores defining said pivot axis.

17. In a rocker arm as in claim 11, said side flanges defining said valve engaging arm outer cantilever end being of a bifurcated configuration, and an anti-friction bearing mounted within said bifurcated configuration having an axis of rotation substantially parallel to said body pivot axis.

18. A rocker arm for use in the valve train of an internal combustion engine comprising, in combination, a unitary, homogeneous, cast metal body including a pair of spaced lateral elongated side flanges, said side flanges being substantially the mirror image of each other and each having a central region and each defining a valve engaging arm and an actuator engaging arm on opposite sides of the associated central region, web means interconnecting said side flanges maintaining said flanges in a substantially parallel spaced aligned relationship, pivot means defined in each said central region of said flanges, said pivot means of said flanges being aligned and coaxial and defining a pivot axis substantially perpendicular to the length of said flanges, said arms each having an end, valve engaging means defined at said end of said valve engaging arm and actuator engaging means defined at said end of said actuator engaging arm, said web means including a pair of spaced webs defining a box cross sectional configuration intermediate said pivot means and said end of said valve engaging arm.

19. A rectangular box cross sectional configuration.

20. In a rocker arm as in claim 19, a bottom web interconnecting said pair of spaced webs and said side flanges, said bottom web and side flanges defining a channel shaped configuration intermediate said pivot means and said end of said valve engaging arm.

* * * * *

UNITED STATES PATENT OFFICE
CERTIFICATE OF CORRECTION

Patent No. 5,060,606 Dated October 29, 1991

Inventor(s) Donald G. Hubbard

It is certified that error appears in the above-identified patent and that said Letters Patent is hereby corrected as shown below:

In claim 4, column 5, line 56, delete "across" and substitute -- cross --.

In claim 10, column 6, line 49, delete "sides" and substitute -- side --.

In claim 19, column 8, line 24, the claim should read as follows:

-- 19. In a rocker arm as in claim 18, said web means defining a rectangular box cross sectional configuration. --

Signed and Sealed this

Twenty-third Day of February, 1993

*Attest:*

STEPHEN G. KUNIN

*Attesting Officer*

*Acting Commissioner of Patents and Trademarks*